United States Patent [19]

Corte et al.

[11] 3,931,809

[45] Jan. 13, 1976

[54] ROTARY INTERNAL COMBUSTION ENGINE

[76] Inventors: Francisco Barcelloni Corte, Corrientes 2021; Pablo Bianco, Av. Pte. Julio A. Roca 610, both of Buenos Aires, Argentina

[22] Filed: Oct. 3, 1973

[21] Appl. No.: 402,978

[52] U.S. Cl. ..... 123/43 R; 123/44 R; 123/44 C

[51] Int. Cl.[2] ..... F02B 57/00; F02B 57/06

[58] Field of Search .... 123/44 R, 44 C, 44 D, 43 R; 91/197; 417/462

[56] References Cited

UNITED STATES PATENTS

| | | | |
|---|---|---|---|
| 890,532 | 6/1908 | Schmucker | 123/44 C |
| 1,114,816 | 10/1914 | Stapp | 123/44 C |
| 1,302,442 | 4/1919 | Sheridan | 123/44 R |
| 1,407,426 | 2/1922 | Kemp | 123/44 R |
| 1,407,659 | 2/1922 | Kemp | 123/44 R |

FOREIGN PATENTS OR APPLICATIONS

| | | | |
|---|---|---|---|
| 1,279,971 | 11/1961 | France | 123/44 D |

*Primary Examiner*—C. J. Husar
*Assistant Examiner*—Michael Koczo, Jr.
*Attorney, Agent, or Firm*—Molinare, Allegretti, Newitt & Witcoff

[57] ABSTRACT

The claimed improved drive means for a rotary internal combustion engine includes means for connecting the piston drive rod to the output drive shaft of the engine which defines a moment arm of variable length for rotating the output drive shaft.

4 Claims, 7 Drawing Figures

ROTARY INTERNAL COMBUSTION ENGINE

BACKGROUND OF THE INVENTION

The present invention relates generally to a rotary internal combustion engine, and more particularly, to an improved drive means for an engine having a rotating block with pistons and cylinders.

Rotary internal combustion engines have been the subject of study for years and recently interest has been generated as a result of concern for the environment. It is generally known, for example, that the rotary engine is a simple and efficient engine, as compared to the conventional internal combustion engine having a crankshaft. Nonetheless, no single design for a rotary engine has heretofore demonstrated sufficient superiority to replace the conventional internal combustion engine.

There are basically two types of rotary engines. One is the Wankel-type rotary engine. The second is a connected internal combustion engine, for example, of the type generally shown in the Barnes patent, U.S. Pat. No. 1,018,953.

Despite the lack of expensive parts, such as a crankshaft, connecting rods, pistons, and valves which are essential in the conventional internal combustion engine, the Wankel-type rotary engine has technical problems, both in operation and construction. These problems include the following: (1) difficulty in closing the complex chambers; (2) lack of proper lubrication to the moving parts which, in many cases, are virtually inaccessible; and (3) excessive friction between moving parts, which results in premature failure and a decrease in power.

The rotary internal combustion engine has similar shortcomings. For example, lubrication of moving parts presents a problem. Intake and exhaust mechanisms are also not reliable and often complex. Most significantly, however, the presently known rotary internal combustion engines include complicated drive means. That is, the presently known rotary internal combustion engines generally drive a shaft in a manner similar to the conventional internal combustion engine. Thus, these engines have the problems and shortcomings associated with the drive means of the conventional internal combustion engine.

SUMMARY OF THE INVENTION

In a principal aspect, the present invention comprises means for connecting the drive rod of the piston to the drive shaft of the engine, whereby the connecting means defines moment arm means of variable length for rotating the drive shaft. The length of the moment arm means is greatest during the power stroke of the piston.

It is, therefore, an object of the present invention to provide a rotary engine which substantially avoids the problems and shortcomings of the presently known rotary engines.

It is also an object of the present invention to provide an improved rotary internal combustion engine. seven It is a further object of the present invention to provide an improved drive means for a rotary internal combustion engine.

It is also an object of the present invention to provide an efficient and reliable drive means for a rotary engine which includes relatively simple parts.

It is another object of the present invention to provide an improved drive means for a rotary engine which may be inexpensively manufactured and constructed.

Other objects of the present invention will become apparent in the detailed description which follows.

BRIEF DESCRIPTION OF THE DRAWINGS

The present invention will be described in detail with reference to the drawings wherein:

FIG. 3 is similar to FIG. 1, except that the engine block is rotated approximately 45°;

FIG. 7 is similar to FIG. 5, except that the engine block is rotated approximately 45°.

DESCRIPTION OF THE PREFERRED EMBODIMENT

In the various figures, the same or equivalent parts are similarly designated.

Figure 1:
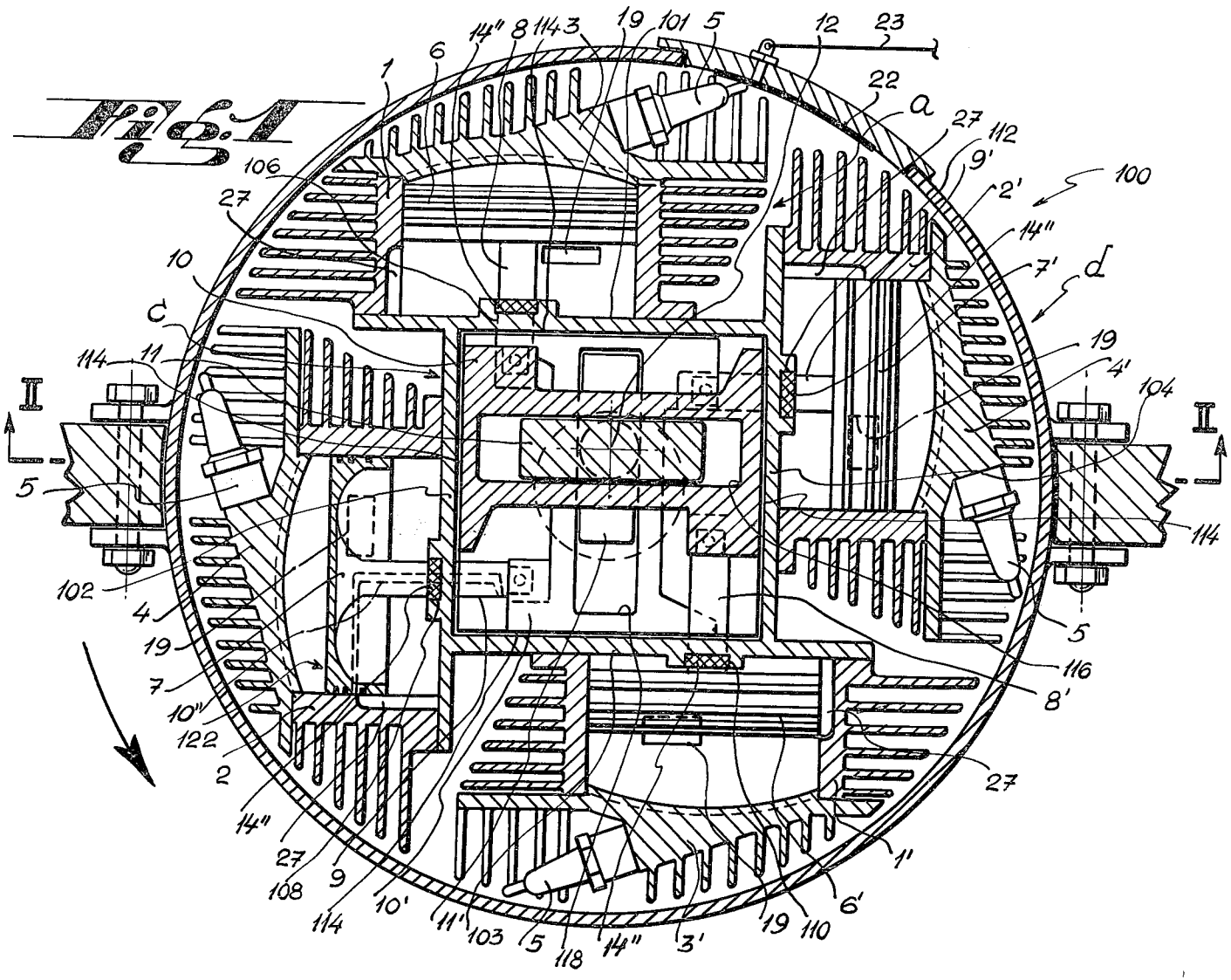
FIG. 1 is a cross-sectional view of a preferred embodiment of the present invention, the section being taken perpendicular to the drive shaft and through the cylinders.
Figure 2:
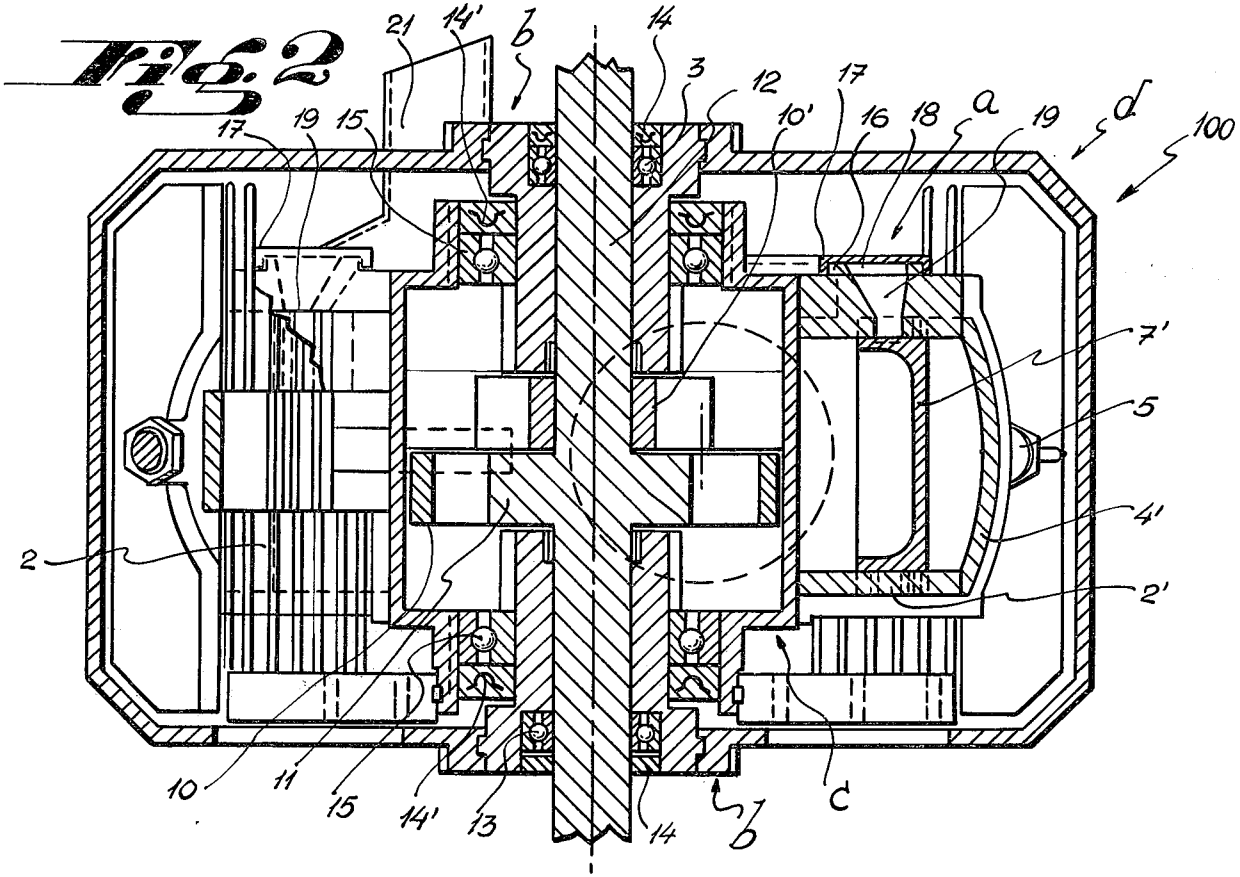
FIG. 2 is a cross-sectional view of the preferred embodiment shown in FIG. 1 taken along II — II.

Referring to FIGS. 1 and 2, a preferred embodiment of the present invention is shown as a rotary internal combustion engine, generally designated 100. The engine 100 includes an enclosure or shroud *d* and a block *a*. The enclosure *d* includes a bearing sleeve *b* and ignition means 23 including an ignition plate 22. The block a is rotatably mounted on the bearing sleeve *b* by means of bearings 15. The bearing sleeve *b* and the bearings 15 are sealed by sealing means 14.

The block a includes a series of cylinders 1, 1′, 2, 2′, heads 3, 24, 4′, pistons 6, 6′, 7, 7′, and drive rods 8, 8′, 9, 9′ push-button. As shown, the engine 100 is a four cylinder engine. It is to be understood, however, that only one cylinder is necessary and the embodiment shown is only an illustration. The cylinders 1, 1′, are opposed, as are the cylinders 2, 2′. Each head 3, 3′, 4, 4′, includes a spark plug 5. Each cylinder 1, 1′, 2, 2′, also includes an intake and exhaust port 19, as well as a bypass port 27.

The cylinders 1, 1′, 2, 2′, are mounted on an output shaft housing *c*. The housing *c* has four walls, 101, 102, 103, 104 and has a substantially square cross-section, as shown in FIG. 1. The housing *c* also includes a series of openings, shown generally at 106, 108, 110, 112, which serve as passageways for the drive rods 8, 8′, 9, 9′.

A pair of yoke members 10, 10′ are located within the housing *c*. The yoke member 10 slidably engages opposed housing walls 102, 104, and yoke member 10′, slidably engages opposed housing walls 101, 103. The yoke members 10, 10′ slide in tracks, generally designated 114, on the walls 101, 102, 103, 104 of housing *c*.

The yoke member 10 includes a keyed slot 116 which of substantially rectangular cross-section, the long side of the rectangle being substantially parallel to the longitudinal axis of the yoke 10. The yoke 10' includes a similar keyed slot 118.

The drive rods 8, 8' of the opposed cylinders 1, 1', respectively, are attached to opposite ends of the yoke member 10, through the openings 106, 110 in the internal housing *c*. The drive rods 9, 9', are similarly secured at opposite ends of the yoke member 10' through the openings 108, 112. The openings 106, 108, 110, 112 are sealed by sealing means, generally designated 14''.

The engine 100 also includes an output drive shaft 12. The drive shaft 12 is rotatably mounted in the bearing sleeve *b* of the enclosure *d*. As shown in FIGS. 1 and 2, the drive shaft 12 has a pair of keying members 11, 11'. The keying members 11, 11' are of substantially rectangular cross-section and are substantially perpendicular to the rotational axis of the drive shaft 12. The longitudinal axis of the keying member 11 is also substantially perpendicular to the longitudinal axis of the keying member 11'.

Referring to FIG. 1, the keying members 11, 11' slidably engage the yoke members 10, 10', respectively. That is, the keying member 11 slides within the keyed slot 116 of the yoke member 10, and the keying member 11' slides within the keyed slot 118 of the yoke member 10'.

From the geometry of FIG. 1, it will be noted that the rotational center or axis of the block *a* is displaced or shifted with respect to the rotational axis of the drive shaft 12. In other words, the rotational axis of the block a and the drive shaft 12 are eccentric.

Figure 4:
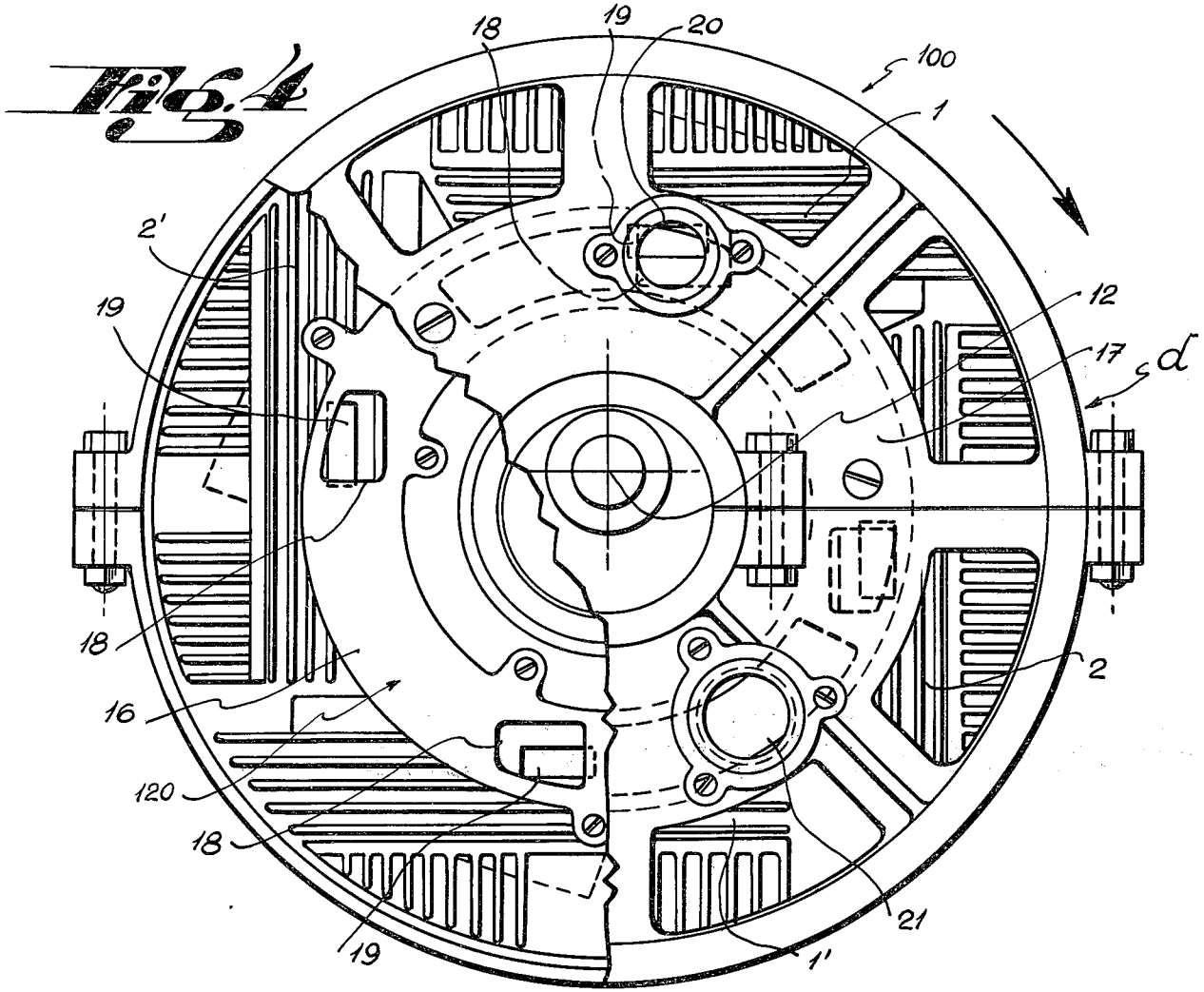
FIG. 4 is a partial cross-sectional rear view of the preferred embodiment shown in FIG. 1, the section being taken along the rotary valve and perpendicular to the drive shaft.
Figure 5:
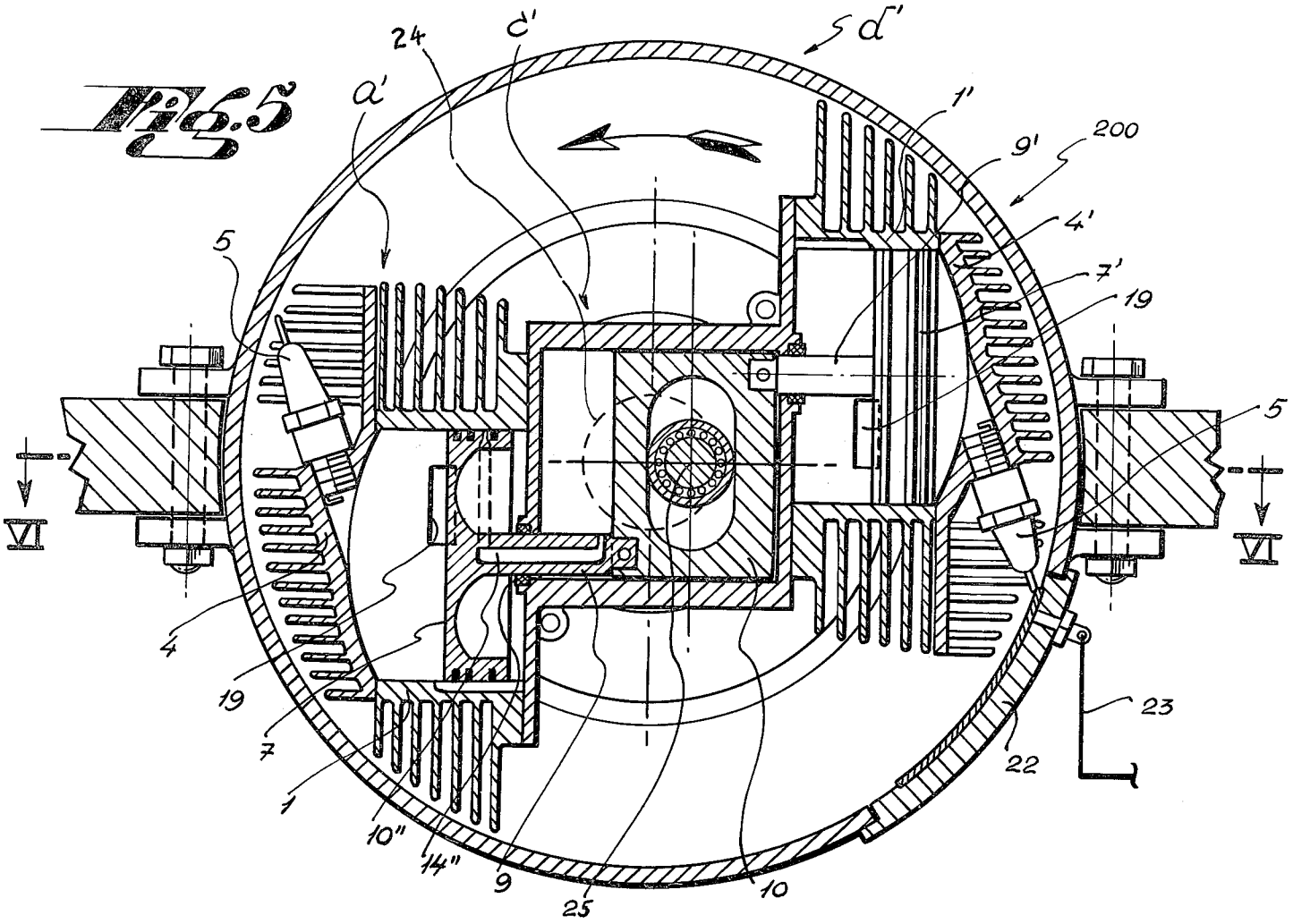

Referring now switches FIG. 4, the intake and exhaust system of the engine 100 is shown as rotary valve means 120. The rotary valve means 120 includes a first valve member 16 and a second valve member 17. The first valve member 16 is secured to and rotates with the block *a*. First valve member 16 includes a series of ports 18, which align with the ports 19 in the cylinders 1, 1', 2, 2'. The second valve member 17 has an intake port 20 and an exhaust port 21. The intake port 20 is connected to a carburetor (not shown). The exhaust port 21 is connected to an exhaust system and muffler (not shown).

The enclosure *d* prevents the second valve member 17 from rotating, although the second valve member 17 is not rigidly secured to the enclosure *d*. Rather, the second valve member 17 floats between the enclosure *d* and the first valve member 16, being maintained against the first valve member 16 by means of tension springs (not shown).

Referring again to FIG. 1, the engine 100 includes lubricating means, generally designated 122. For the sake of clarity, lubricating means 122 has only been shown in the cylinder 2, piston 7 combination. It is to be understood, however, that each piston 6, 6', 7, 7', is similarly designed.

The lubricating means 122 includes an oil duct 10''. The duct 10'' extends from the housing *c* through the drive rod 9 to the edge of the piston 7.

Figure 5:
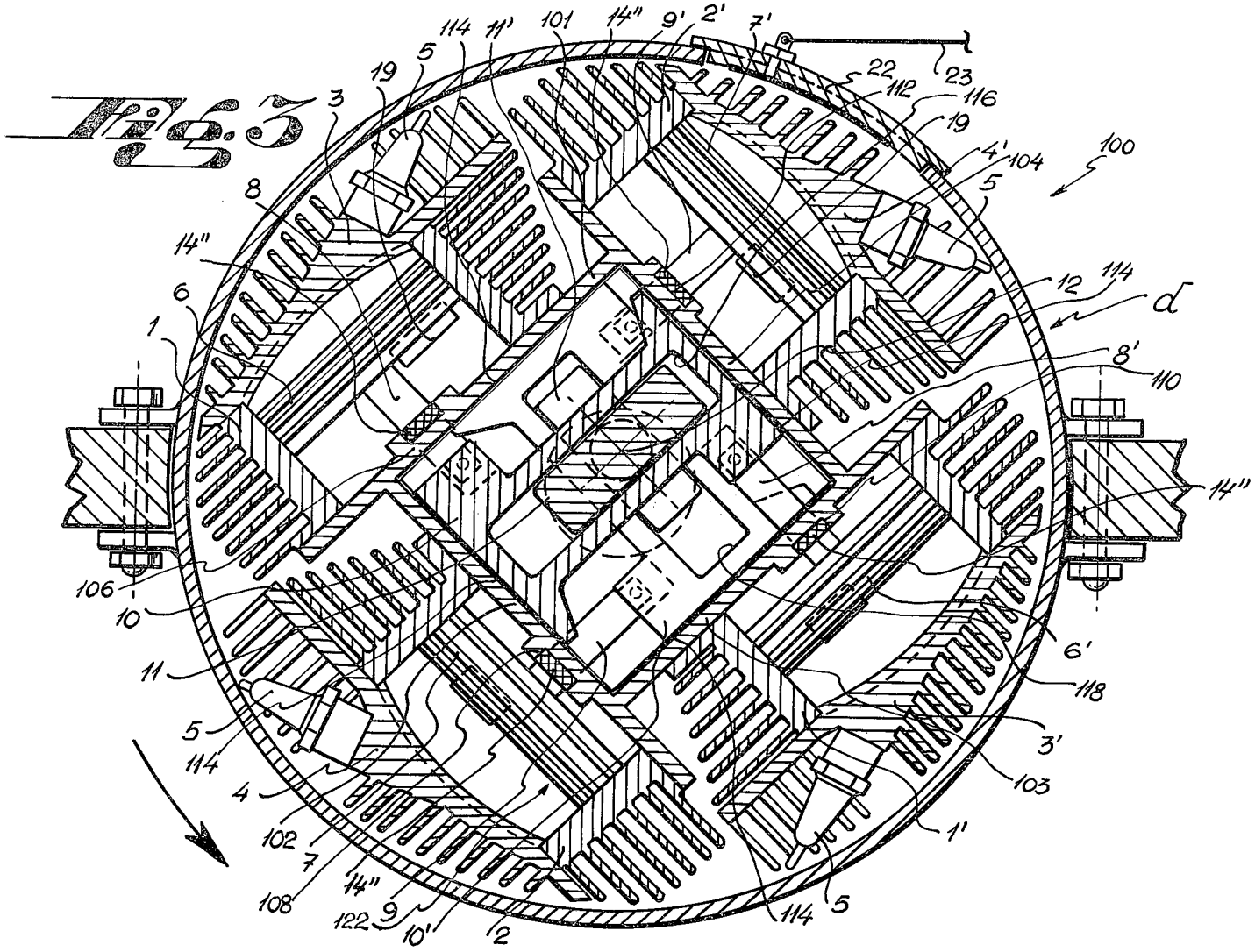
FIG. 5 is a cross-sectional view of a second preferred embodiment of the present invention, the section being taken perpendicular to the drive shaft and through the cylinders.
Figure 6:
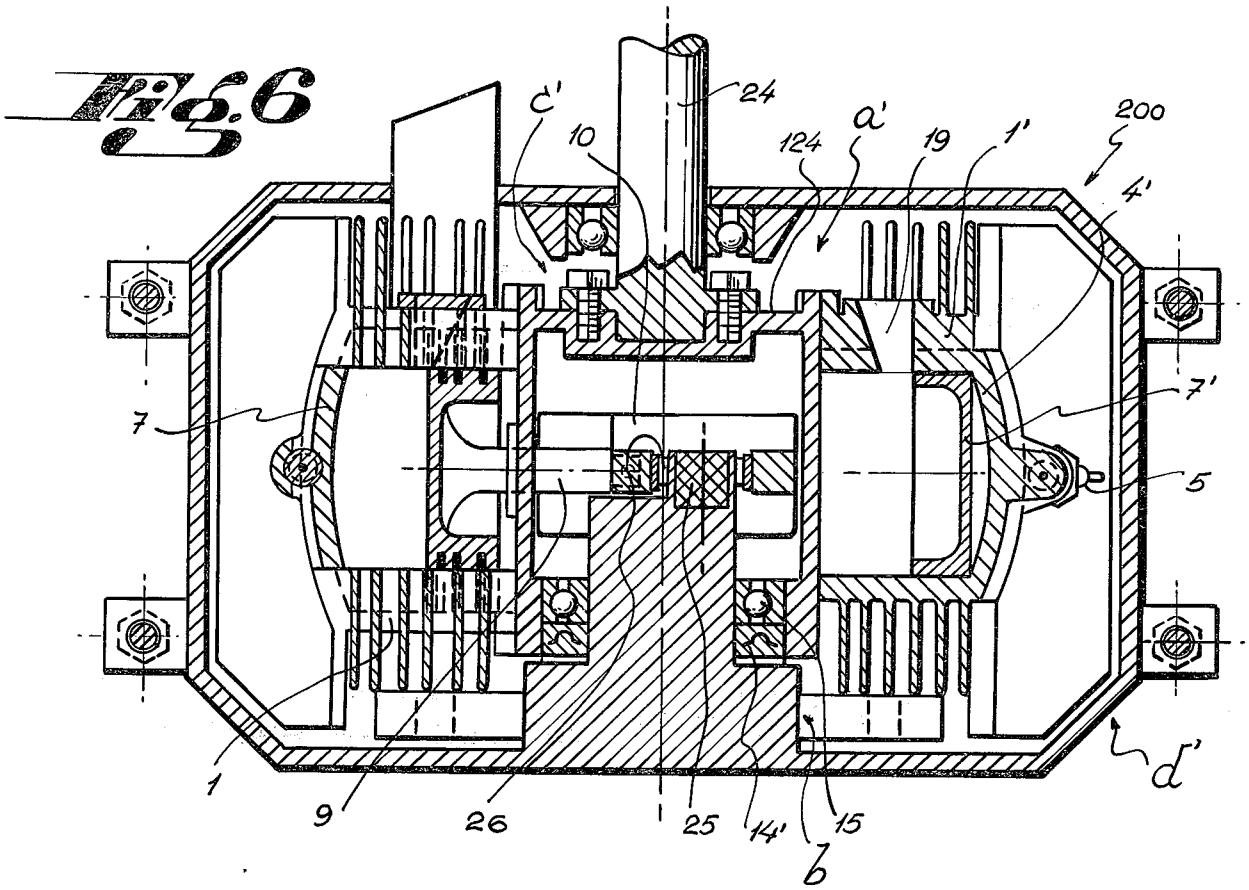
FIG. 6 is a cross-sectional view of the preferred embodiment shown in FIG. 5, taken along VI — VI.
Figure 5:
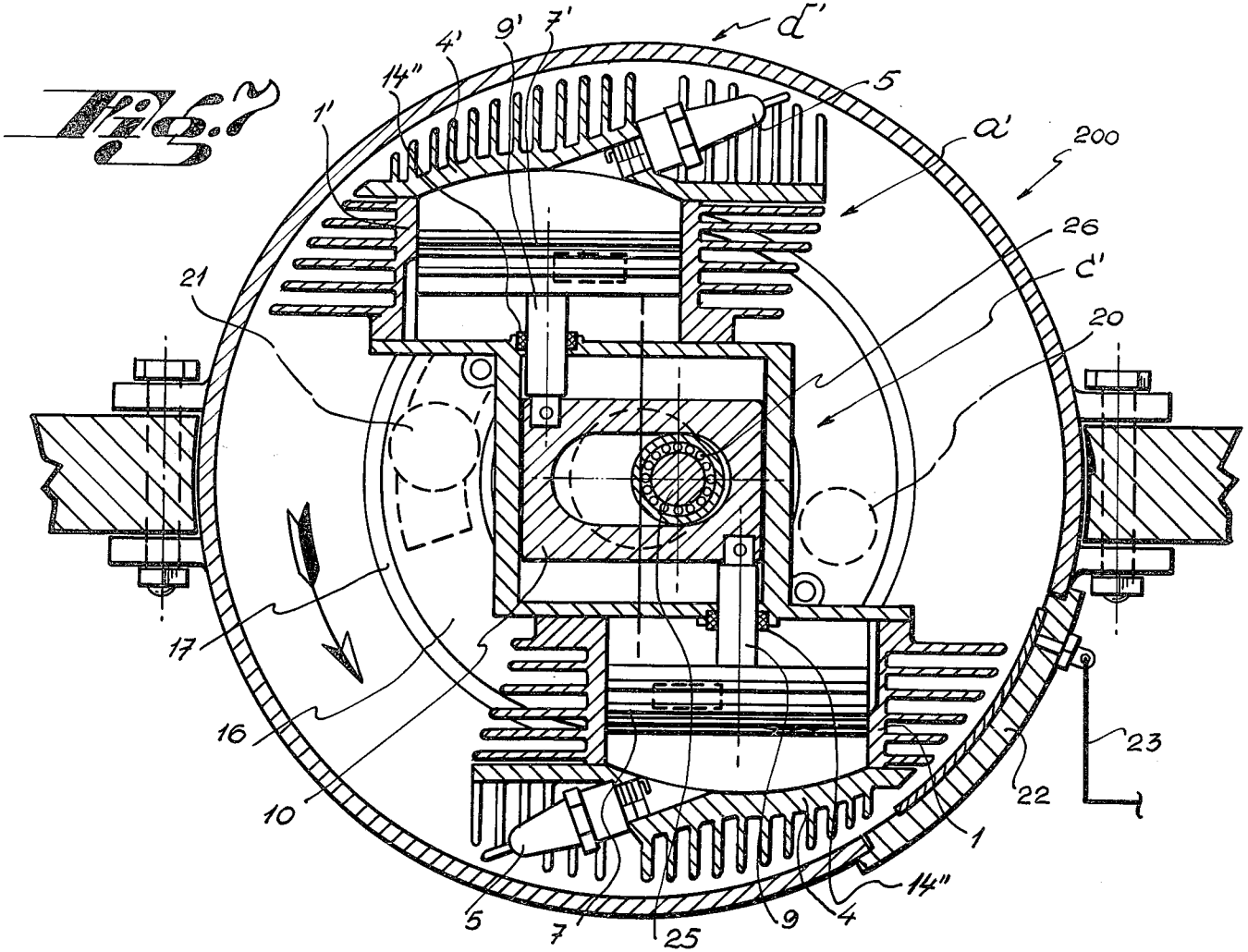

Referring to FIGS. 5, 6, and 7, a second embodiment of the present invention is shown and generally designated as a rotary internal combustion engine 200. The engine 200 is a two cylinder engine, and thus, the engine 200 has a combinational yoke member 10. This is again only an illustration and any number of cylinders may be used.

The engine 200 includes a drive shaft 24. As shown in FIG. 6, the drive shaft 24 is rigidly secured to a back wall 124 of the housing *c*. The energy of the block *a* is, therefore, transmitted directly to the drive shaft 24.

The yoke member 10 rotates about a pin 25 which includes a bearing 26. The pin 25 is rigidly mounted on the bearing sleeve *b* of the enclosure *d*. The axis of the pin 25 and bearing 26 is displaced with respect to the rotational axis of the block *a*.

Referring now to FIGS. 1 and 3, the operation of the engine 100 will be described. In FIG. 1, the cylinder 1 and piston 6 are shown at the completion of the compression stroke. The spark plug 5 associated with cylinder 1 is in contact with the ignition plate 22, and ignition means 23 carries an ignition potential.

With combustion, the expansion force of the ignited gases operates on the piston 6 and the drive rod 8 exerts a driving force on the yoke member 10. The drive rod 8, the yoke member 10, and the keying member 11 cooperate to define drive means, generally designated 126.

A comparison of FIGS. 1 and 3 shows the drive means 126 is, in effect, moment arm means for rotating the drive shaft 12. Due to the eccentricity of the block *a* and the drive shaft 12, the length of the moment arm means varies as the block *a* rotates. The engine 100 is designed such that the moment arm means is of maximum length during the power delivery stroke of the pistons 8, 8', 9, 9', resulting in maximum power.

The force exerted by the piston 8 on the yoke member 10 causes the block *a* to rotate. The rotation of the block *a* effects the rotation or driving of the drive shaft 12. The block *a* makes two revolutions per piston cycle. That is, two revolutions of the block *a* are required for the intake, compression, power and exhaust steps.

The intake and exhaust operations are shown in FIGS. 1 and 4. As the piston 6 of the cylinder 1 completes the compression stroke, a partial vacuum is created in the lower portion of the cylinder 1, i.e., the portion of the cylinder 1 between the piston 6 of the housing *c*.

At the completion of the compression stroke, the intake port 20 of the second valve member 17 aligns with the port 18 of the first valve member 16. Thus, the partial vacuum is filled with a combustible air-gas mixture from the carburetor (not shown).

As the block a rotates and the cylinder 1 completes its power stroke (i.e., the cylinder 1 is in the position of cylinder 1' shown in FIG. 1), the port 19 of the cylinder 1 comes into alignment with the exhaust port 21 of the second valve member 17. Simultaneously, the bypass port 27 is opened and the air-gas mixture, now compressed in the lower portion of the cylinder 1, rushes into the upper portion of the cylinder 1, thereby forcing the burnt gases through the exhaust port 21.

Referring again to FIG. 1, the operation of the lubricating means 122 will be described. In the embodiment shown, the housing *c* acts as a lubricant reservior. Centrifugal force created by the rotation of the block *a* moves the lubricant (not shown), in suitable quantity, through the duct 10'' to the cylinder-piston interface.

Several advantages are derived from the present invention. First, the engines 100 and 200 have fewer component parts than the conventional internal combustion engine. More specifically, the expensive crankshaft and its related parts have been eliminated.

Although operating on a rotary theory, the present invention substantially avoids the chamber sealing problems experienced in the Wankel-type rotary engine. This is a result of the conventional cylinders and pistons used in the present invention.

Lubrication problems are substantially avoided because the housing c is the lubricant reservoir. Thus, the parts of the present invention which require substantial lubrication, i.e., the yoke members 10, 10', and the keying members 11, 11', are continually bathed in lubricant. The cylinders 1, 1', 2, 2' as described above, are inherently lubricated by means of the centrifugal force developed with rotation of the block *a*.

The present invention has been described with particular reference to preferred embodiments thereof. It should be understood that the detailed description is illustrative only and various changes and modifications may be made without departing from the true spirit and scope of the present invention.

What we claim is:

1. In a rotary internal combustion engine of the type which includes a fixed engine frame, a block rotatable about a block axis, an output shaft rotatable about a shaft axis, said shaft axis being offset from said block axis to define an eccentricity, at least one cylinder means including a cylinder housing, a piston and a drive rod, said piston having an edge surface slidably engaging said cylinder housing, said drive rod being connected to said piston, said cylinder means having a cycle including a power stroke, means for supplying a combustible mixture to said cylinder means, and ignition means for igniting said combustible mixture in said cylinder means, an improved means for driving said output shaft comprising, in combination:

a housing within said block and rotatable about said one block axis, said housing having at least a pair of opposing walls and substantially enclosing said output shaft, said housing defining a lubricant reservoir for said rotary engine;

a key member rigidly secured to said output shaft;

a yoke member slidably engaging said opposing walls of said housing, said key member slidably engaging said yoke member, said yoke member being rotatable substantially about said shaft axis; and means for connecting said drive rod and said yoke member to define a connection point, said connection point being radially offset from said block axis throughout said cycle of said cylinder means;

said housing, yoke member, key member, connecting means and eccentricity cooperatively defining variable moment arm means for rotating said block and output shaft in response to said cylinder means, said variable moment arm means having a predetermined length at initiation of said power stroke and a maximum length during said power stroke.

2. An improved driving means as claimed in claim 1 wherein said yoke member defines a slot extending substantially between said walls of said housing.

3. An improved driving means as claimed in claim 2 wherein said key member slidably engages said slot.

4. An improved driving means as claimed in claim 1 wherein said piston and drive rod define a duct, said lubricant reservoir communicating with said edge surface of said piston through said duct, whereby said cylinder means is lubricated.

* * * * *